United States Patent [19]

Hudson et al.

[11] Patent Number: 4,736,569

[45] Date of Patent: Apr. 12, 1988

[54] DUST FLAP TUCKING MECHANISM FOR USE IN FORMING SLEEVE-TYPE CARRIERS

[75] Inventors: Donald R. Hudson, West Monroe; Peter C. Olsen, Jr., Monroe; Rhonda P. Bryan, West Monroe, all of La.

[73] Assignee: Manville Corporation, Denver, Colo.

[21] Appl. No.: 17,123

[22] Filed: Feb. 20, 1987

[51] Int. Cl.[4] ..... B65B 7/20

[52] U.S. Cl. ..... 53/374; 53/381 R

[58] Field of Search ..... 53/235, 251, 374, 377, 53/381 R, 467, 468, 491, 566; 493/10, 23, 177, 425, 453

[56] References Cited

U.S. PATENT DOCUMENTS

| | | | |
|---|---|---|---|
| 2,984,959 | 5/1961 | Walther et al. | 53/374 |
| 3,007,293 | 11/1961 | McGihon | 53/566 X |
| 3,681,893 | 8/1972 | De Barge | 53/374 X |
| 4,460,349 | 7/1984 | Charron | 493/177 X |
| 4,503,659 | 3/1985 | Sherman | 53/491 |
| 4,569,182 | 2/1986 | Leuvering | 53/491 X |
| 4,642,967 | 2/1987 | Culpepper | 53/381 R X |

FOREIGN PATENT DOCUMENTS

| | | | |
|---|---|---|---|
| 2065589 | 7/1981 | United Kingdom | 53/374 |

*Primary Examiner*—Robert L. Spruill
*Assistant Examiner*—Steven P. Weihrouch
*Attorney, Agent, or Firm*—John D. Lister; Cornelius P. Quinn; Timothy R. Schulte

[57] ABSTRACT

Apparatus for pushing a loaded open-ended carrier sleeve and folding the trailing dust flaps of the sleeve. Flight bars attached to endless chains located below the path of travel of the carrier sleeve initially move the sleeve. Pusher bars or lugs attached to endless chains located above the path of travel of the carrier sleeve engage the trailing panel of the sleeve and accelerate the sleeve away from the flight bars. Fingers attached to the pusher bars contact the trailing dust flaps prior to the pusher bars contacting the trailing panel of the sleeve and fold the trailing dust flaps before the sleeve is accelerated along its path of travel.

8 Claims, 4 Drawing Sheets

S
C
45
62
22
34
82
53
46
74
72
76
78
80
60
20
56
64

DUST FLAP TUCKING MECHANISM FOR USE IN FORMING SLEEVE-TYPE CARRIERS

FIELD OF THE INVENTION

This invention relates to a method and apparatus for tucking or folding the trailing dust flaps of a moving open-ended sleeve during the process of packaging articles in a sleeve-type carrier.

BACKGROUND OF THE INVENTION

One type of carrier often used to package twelve or twenty-four beverage cans is the sleeve-type carrier. Such a carrier is enclosed on all sides and is typically formed from a generally rectangular paperboard production blank which has been folded and glued by the blank manufacturer to form an interim sleeve-like product consisting of connected top, bottom and side panels. This interim product is shipped in flat collapsed form to a bottling plant where, through use of an automatic packaging machine, the collapsed sleeve is opened into its full sleeve shape, cans are inserted into the sleeve, and the end panels of the carrier are formed by gluing together flaps which are foldably connected to the blank.

More specifically, after the beverage cans have been inserted through the open ends of the sleeve the first step in forming the end panels of the package is to first fold the dust flaps toward each other. Prior to the folding operation the dust flaps extend outwardly from the vertically aligned leading and trailing panels as the sleeve moves along its path of travel through the packaging machine. Subsequently the end flaps extending outwardly from the upper and lower panels of the sleeve are folded toward each other and glued to the dust flaps to complete the formation of the end panels.

The leading dust flaps conventionally are folded back by stationary rails or rods which contact the flaps and force them back and inwardly as the carrier sleeve moves past the rails. This has been found to be an efficient, practical way to carry out this operation and is not in need of change. By the same token, the downward and upward folding of the end flaps can be efficiently carried out by stationary rails or other simple folding apparatus.

The method of folding the trailing dust flaps forward, however, is a different matter. Because the flaps have to be folded in the same direction as the movement of the carrier sleeve, static rails cannot be used. Over the years a number of different types of flap closing methods have been employed, but in general they have suffered from the problem of being too complicated. When mechanisms designed to operate at the extremely high speeds of a modern packaging machine are too complicated, depending on a number of moving parts required to have precisely timed operations in order to mesh with other operations of the machine, the possibility of a breakdown is increased. For example, the use of a tucker wheel mounted to rotate about a vertical axis, which folds in the trailing flap as the carrier sleeve moves by, requires a drive mechanism, a clutch, a tuning sprocket to enable adjustments to be made, a gear box and the tucker assembly itself. Obviously, the cost of such apparatus or of other still more complicated folding equipment is high and maintenance of the equipment is demanding.

It would therefore be desirable to have a more simple, yet highly efficient method of folding the trailing dust flaps of a sleeve-type carrier during the packaging operation.

BRIEF SUMMARY OF THE INVENTION

This invention provides a simple means for folding the trailing dust flaps of an open-ended sleeve in the process of forming a sleeve-type carrier package. A pushing mechanism is employed to engage the trailing panel of the open-ended sleeve and push the sleeve along its path of travel through the packaging machine. Attached to the pushing mechanism are extensions or fingers which engage the outwardly extending trailing dust flaps and fold them toward the leading panel of the sleeve. Thus the normal movement of the pusher means toward the trailing panel of the sleeve causes the fingers to fold the trailing dust flaps in a forward direction.

To ensure a continuous positive feed of the sleeve at all times, an initial sleeve moving mechanism functions while the fingers are folding the dust flaps. The pusher mechanism associated with the fingers takes over after the trailing dust flaps have been folded to continue the movement of the sleeve.

These and other features and aspects of the invention, as well as its various benefits, will be made more clear in the detailed description of the preferred embodiment of the invention which follows.

DESCRIPTION OF THE INVENTION

Figure 1:
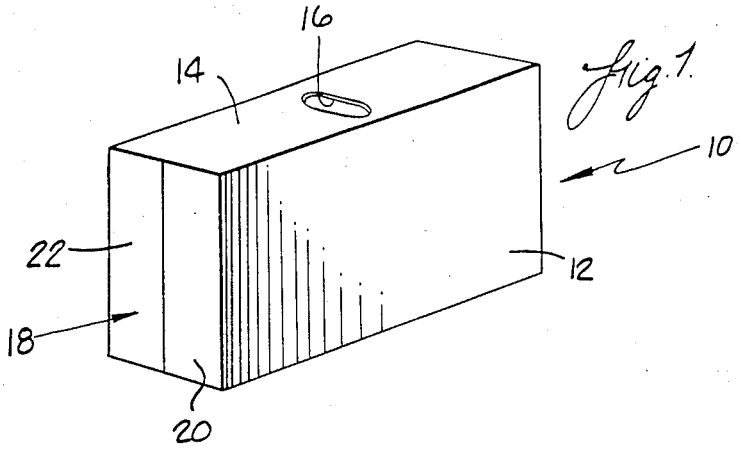
FIG. 1 is a pictorial representation of a completely formed sleeve-type beverage carrier of the type to which this invention relates.

Referring to FIG. 1, a fully formed sleeve-type beverage carrier 10 has side panels 12, an upper panel 14 containing a handle opening 16, a bottom panel on which the carrier is resting and therefore is not visible, and end panels 18. The end panels are formed by the end flaps 20 and 22 which have been glued to dust flaps to hold the end flaps in place. This is the typical design of a sleeve-type carrier in which twelve or twenty-four beverage cans are packaged.

Figure 2:
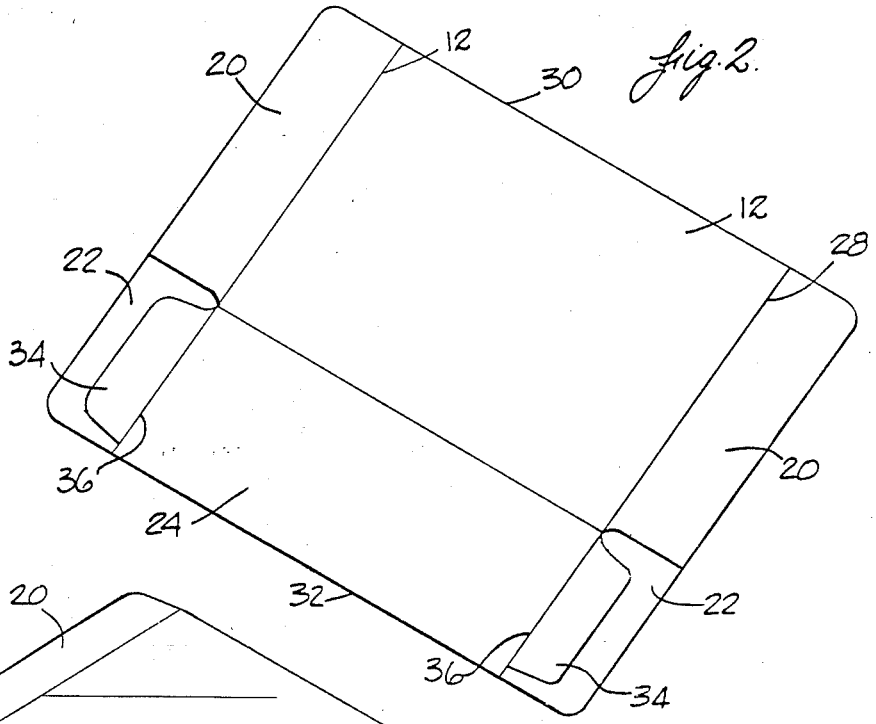
FIG. 2 is a pictorial representation of a carton blank of the type used to form the carrier of FIG. 1, shown after it has been formed into a collapsed sleeve.

Such carriers are erected from generally rectangular blanks of paperboard which are formed into collapsed sleeves of the type shown in FIG. 2, which shows a side panel 12, a bottom panel 24, and upper and lower end flaps 20 and 22, respectively. The bottom panel 24 is connected to the side panel 12 by fold line 26 and the upper end flaps are connected to the side panel 12 by fold lines 28. The side panel 12 is connected by fold 30 to the upper panel 14, not shown but situated on the underside of the collapsed sleeve, and bottom panel 24 is connected to the underlying side panel by fold 32. It should be understood that the underlying side panel is also connected to the folded upper panel by a fold line similar to the fold line 26 connecting the exposed side panel 12 with the bottom panel 24. Also shown are dust flaps 34 which are connected by fold lines 36 to the bottom panel 24. Similar dust flaps, hidden from view, are foldably connected to the upper panel.

Figure 3:
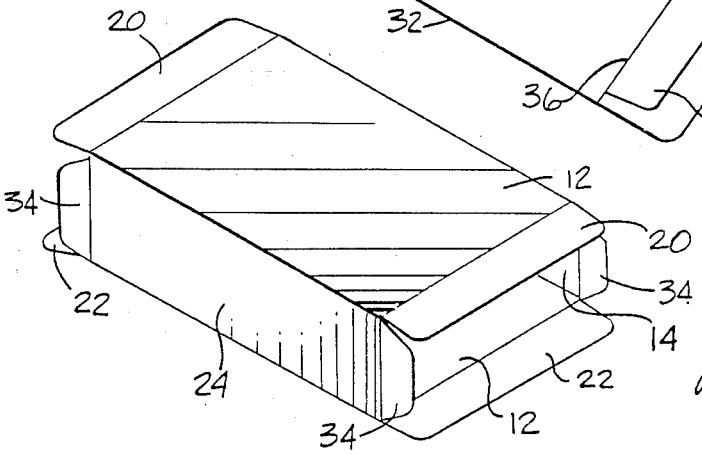
FIG. 3 is a pictorial representation of the collapsed sleeve of FIG. 2 after it has been opened into sleeve form.

FIG. 3 shows the collapsed sleeve of FIG. 2 after it has been fully opened, but prior to filling the carrier with beverage cans. As can be seen, the upper and bottom panels 14 and 24 have been swung up to vertical and the side panels 12, foldably connected to the upper and bottom panels, are horizontally disposed. This allows the beverage cans to be inserted through both ends of the sleeve in their upright position, after which the dust flaps 34 are folded in and the end flaps 20 and 22 are folded and bonded to them to form the carrier configuration shown in FIG. 1. As it moves through the packaging machine the open sleeve is in the attitude shown in FIG. 3, wherein one of the side panels 12 of the fully formed carrier is the upper panel of the sleeve and the other side panel of the carrier is the bottom panel of the sleeve. The top panel 14 of the carrier shown in FIG. 3 is the leading panel of the sleeve as it moves through the packaging machine and the bottom panel 24 of the carrier is the trailing panel of the sleeve. Thus the dust flaps 34 connected to the leading panel 14 are the leading dust flaps of the sleeve and the dust flaps 34 connected to the trailing panel 24 are the trailing dust flaps. This panel and flap nomenclature will be used in the specification and the claims when referring to the sleeve during its travel through the packaging machine.

Figure 4:
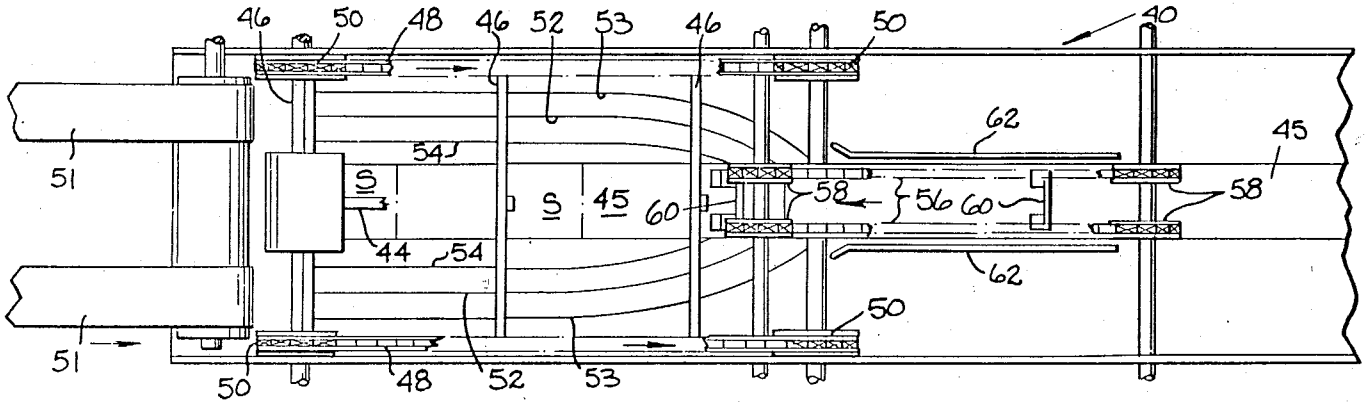
FIG. 4 is a partial schematic plan view of a packaging machine incorporating the folding mechanism of the present invention.
Figure 5:
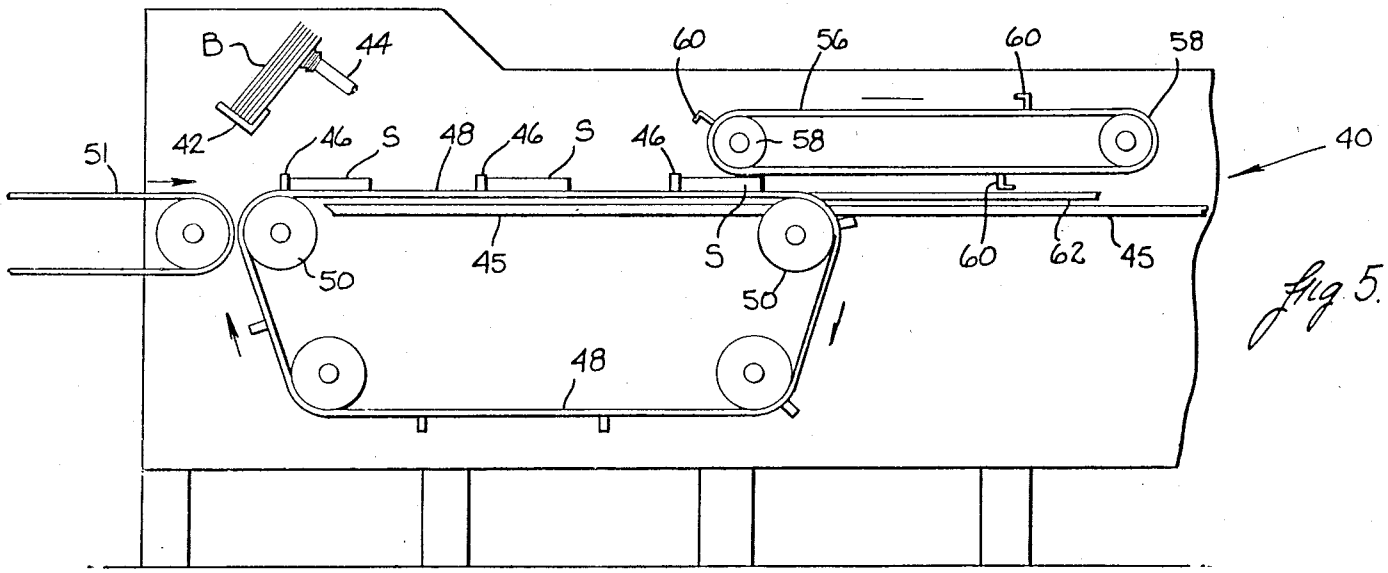
FIG. 5 is a partial schematic side elevation of the machine of FIG. 4.

Referring to FIGS. 4 and 5, a packaging machine 40 comprises a hopper 42 which holds a stack of collapsed sleeves B. The lowermost sleeve in the hopper is removed by means well known in the art, such as by an oscillating suction device 44, and is deposited on a support plate 45 in the pocket between successive flight bars 46. The ends of the flight bars 46 are attached to continuous chains 48 trained about sprockets 50, one of the shafts on which the sprockets are mounted being the drive shaft. The chains are moved in a clockwise direction as viewed in the drawing.

Each collapsed sleeve B is opened into the form shown in FIG. 3 either while it is in the pocket or as it is moving to the pocket by any of the means well known in the art. The particular manner in which the collapsed sleeve is opened is of no significance to the present invention. The opened sleeve S is moved toward the right by being pushed by a flight bar 46 so that it slides along the support plate 45. Although the support plate 45 is illustrated as being comprised of a single plate, obviously spaced narrower plates could also serve the same function.

Beverage cans to be packaged are introduced to the machine at the upstream end, as by feed conveyors 51. The cans are pushed by the flight bars 46 in a manner well known in the art so that one group of cans slides along a support surface between guide rails 52 and 54 and another group slides along between guide rails 52 and 53. The guide rails are arranged so that they are generally parallel to each other but converge toward the support plate 45. Thus, as the two groups of cans are pushed along opposite sides of the machine by a flight bar 46, they eventually reach a point where they converge to meet with the opposite open ends of a moving sleeve and are pushed by continued movement of the flight bar into the sleeve. By way of example, if each group were made up of three cans, six cans would be pushed into the open sleeve from each end, resulting in a twelve-pack, as will be made more clear in connection with FIG. 6.

Still referring to FIGS. 4 and 5, two parallel endless chains 56 are trained about sprockets 58, one of which would be connected to a drive shaft. The endless chains are mounted over the support surface 45 so that the upstream sprocket 58 is upstream from the downstream sprocket 50 of the flight bar endless chains 48. Thus the extent of the runs of the endless chains 48 and 56 overlap.

Carried on the endless chains 56 and extending therebetween are lug or pusher bar assemblies 60 which are arranged to contact the trailing panel of the open sleeves S and take over the pushing or moving function from the flight bars. Continued movement of a sleeve S past the stationary rails 62 causes the leading dust flaps of the sleeve to be folded back to become the support against which the end flaps of the sleeve will be adhered to form the end panels. The structure used for folding and gluing the end flaps is not shown since it forms no part of the present invention and since there are many well known satisfactory arrangements which could be utilized.

Figure 6:
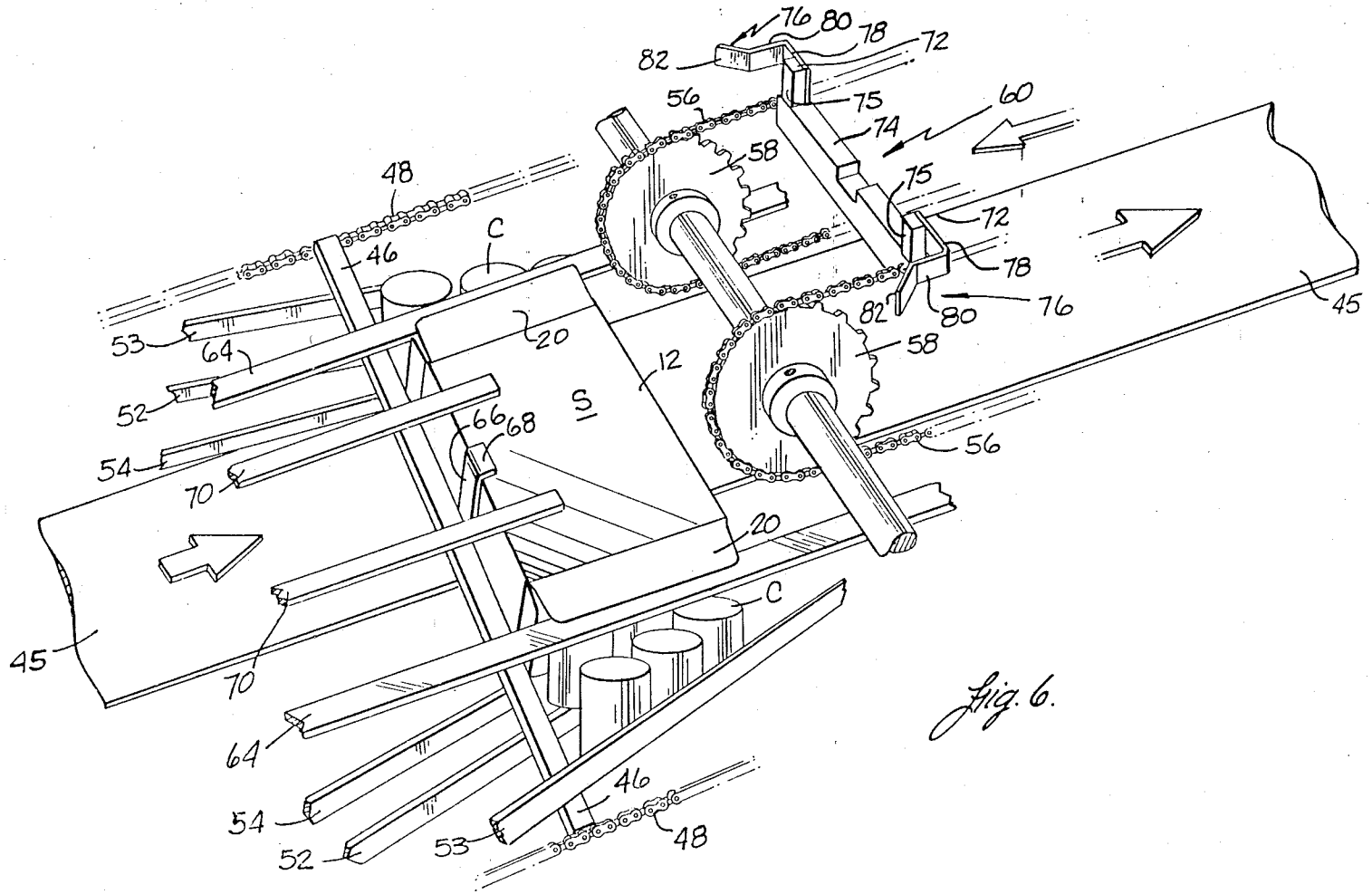
FIG. 6 is a partial pictorial representation of the packaging machine of FIG. 4, showing the sleeve moving means and the flap tucking or folding fingers of the present invention.

Referring to FIG. 6, the relationship of the various components of the invention will be made more clear. The sleeve S is shown with its dust flaps 34 and end flaps 20 extending outwardly from the trailing panel 24 and upper panel 12, respectively. The ends of the upper end flaps 20 are resting on the overhead rails 64 to maintain the flaps in open condition so that the cans C can be introduced to the sleeve without obstruction. The cans have been moved to the position shown in the drawing by flight bar 46 and guided toward the open ends of the sleeve by converging guides 52, 53 and 54. Continued movement of the flight bar will push the cans all the way into the sleeve, at which time the flap closing operation would begin. The flight bar 46 may be provided with one or more vertical extension lugs, if desired, to ensure better control of the sleeve as it moves along the support surface 45. For purpose of illustration, a single extension lug 66, having a short horizontal flange 68 overlying the upper panel 12, is shown engaging the trailing panel 24 of the sleeve midway between the sleeve ends. Additional overhead rails 70 may be provided in order to further stabilize the carrier sleeve as it moves along the support surface 45.

Still referring to FIG. 6, the lug or pusher bar arrangement 60 is shown in more detail. Although the lug design can take any form that produces the desired result, in the embodiment shown the pusher bar arrangement 60 comprises two lugs 72 connected by a plate 74. The flat surfaces 75 of the lugs are arranged to contact the trailing panel of the sleeve. Connected to the lugs 72 are fingers 76 which comprise an outwardly extending portion 78, a portion 80 at right angles thereto, and an end finger portion 82 extending outwardly from the portion 80 at an acute angle. The purpose of the fingers 76 is to contact the trailing dust flaps 34 and fold them to their closed position prior to the lugs 72 contacting the trailing panel of the sleeve. The length of the outwardly extending portion 78 should be such that the lugs 72 are able to firmly contact the trailing panel of a sleeve while still allowing the finger portions to move past the trailing panel to fold in the trailing dust flaps.

Figures 7, 8, 9, 10, 11:
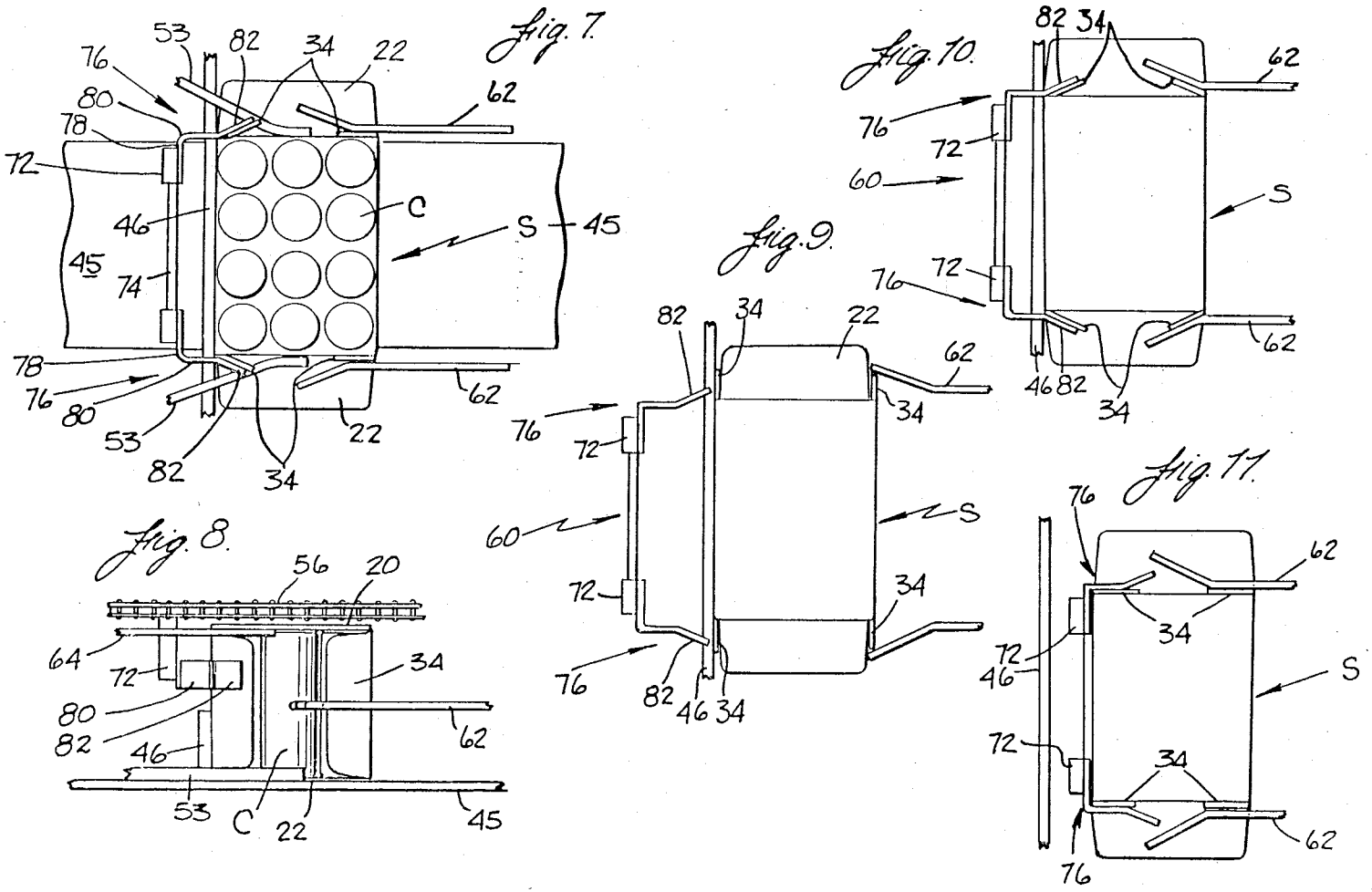
FIG. 7 is a partial plan view, with certain structure removed for purpose of clarity, of a carrier sleeve as it would appear at an intermediate point in the trailing dust flap folding operation.
FIG. 8 is a partial side elevation of the sleeve and structure of FIG. 7.
FIG. 9 is a schematic plan view of a carrier sleeve just prior to its trailing dust flaps being contacted by the folding fingers.
FIG. 10 is a view similar to that of FIG. 9, but showing the trailing dust flaps at an intermediate stage of the folding process.
FIG. 11 is another view similar to that of FIG. 9, but showing the trailing dust flaps in their fully folded position.

This operation can be better understood by reference to FIGS. 7 and 8, which show a sleeve S at a location downstream from the sleeve location shown in FIG. 6. The cans C have been fully inserted into the sleeve in these views, the final movements of the cans having been guided by the extremities of the outer can guides 53 shown on each end of the sleeve. The upper end flap 20 is still being held in outwardly extended condition by the rail 64, but it can be seen that the rail terminates at this location and that continued movement of the sleeve will move the flap 20 out of contact with the rail, allowing the flap to be folded down against the dust flaps. Similarly, lower end flaps 22 can be held down by a plate or rail, not shown, which would also terminate in the same general location as the rail 64. The leading dust flaps 34 have been folded back to their closed position by the relative movement between the dust flaps and the stationary rails 62. The sleeve at this point is still being moved by the flight bar 46.

Still referring to FIGS. 7 and 8, it can be seen that the lugs or pusher bars 72 have not yet come in contact with the trailing panel of the sleeve, but the end finger portions 82 of the finger assemblies 76 have contacted the trailing dust flaps 34 and folded them forward to a position short of closed. Continued movement by the finger assemblies 76 would cause the straight finger portions 80 to contact the trailing dust flaps and complete the folding operation under the dust flaps are completely closed. An important point to the understanding of the operation of this dust flap closing mechanism is the need to run the endless chains 56 at a speed such that the rate of travel of the lug assembly 60 along the path of travel of the sleeve S is slightly faster than the rate of travel of the flight bars. This allows the finger extremities to contact the trailing dust flaps while the sleeve is still being moved by the flight bar, and to continue to move downstream relative to the moving sleeve so that the straight portions 80 of the fingers 76 can complete the folding operation.

The sequence of operation described above is illustrated in FIGS. 9, 10 and 11. In FIG. 9 the sleeve S is shown as it would appear when the leading dust flap 34 has just reached the stationary folding rail 62 and the finger extension 82 of the finger mechanism 76 is about to reach the trailing dust flap 34. At this point the lugs 72 have not reached the trailing panel of the sleeve and the sleeve is being pushed along its path of travel by the initial carrier sleeve moving means, the flight bar 46.

In FIG. 10, the sleeve has moved downstream to a point where the stationary rails 62 have substantially completed the folding of the leading dust flaps 34 and the folding of the trailing dust flaps by the finger extremities 82 has begun. Although the lugs 72 have moved closer to the trailing panel of the sleeve due to the greater speed at which the lug assembly 60 moves compared to the flight bar 46, the movement of the sleeve is still under the control of the flight bar.

The sleeve in FIG. 11 is shown just after the lugs 72 have caught up to and contacted the trailing panel of the sleeve. The movement of the sleeve will have been accelerated so that the sleeve is now moving faster than the flight bar 46 and so is a slight distance downstream from the flight bar. The fingers 76 have completed their folding operation of the trailing dust flaps and of course the folding of the leading dust flaps by the stationary folding rail 62 has been completed. From this point on the lugs 72 will move the sleeve in a downstream direction, past the end flap folding and gluing station, not shown, and on to any desired type of discharge station.

It can now be appreciated that the present invention provides a simple mechanism for folding the trailing dust flaps of a sleeve-type carrier, the folding fingers simply being attached to the overhead lug sleeve pushing assembly. Because of the difference in speeds between the flight bars and the overhead lugs, and the resulting accelerated movement of the sleeve after the lugs contact the trailing panel of the sleeve, the sleeve is always under positive pushing movement by either the flight bars or the lugs during the can filling and flap closing operations. Thus there are no dead spots where the sleeve is sliding or coasting under its own momentum.

The machine is compact, easy to maintain and does not require costly components to carry out the trailing dust flap folding operation.

It should further be obvious from the foregoing that although a preferred embodiment of the invention has been described, it is possible to make changes to certain specific details of the apparatus without departing from the spirit and scope of the invention.

What is claimed is:

1. In an apparatus for packaging articles in a sleeve-type carrier:

first means for moving an open-ended carrier sleeve a predetermined distance along a path of travel;

the sleeve having a leading panel, a trailing panel, and upper and lower panels, the leading and trailing panels having dust flaps extending outwardly therefrom and the upper and lower panels having end flaps extending outwardly therefrom, the dust flaps being adapted to be folded toward each other and the end flaps being adapted to be folded toward each other so as to overlap the dust flaps to form the end panels of the carrier;

second means for moving the carrier sleeve along the path of travel after the first carrier sleeve moving means has moved the sleeve said predetermined distance;

the second carrier sleeve moving means including means for engaging the trailing dust flaps after the articles to be packaged have been inserted into the sleeve and folding said dust flaps toward the leading panel of the sleeve;

the second carrier sleeve moving means comprising a stationary surface for supporting the carrier sleeve and pusher means for engaging the trailing panel of the sleeve and pushing the sleeve over the stationary support surface;

the second carrier moving means including finger means for engaging the rear face of the trailing dust flaps prior to the engagement of the trailing panel by the pusher means, whereby continued movement of the second carrier moving means after the initial engagement of the trailing dust flaps by the finger means causes the finger means to fold the trailing dust flaps toward the leading panel of the sleeve prior to engagement of the trailing panel by the pusher means.

2. Apparatus according to claim 1, wherein the finger means are fixedly attached to and extend from the pusher means.

3. Apparatus according to claim 1, wherein the pusher means is attached to endless chain means positioned above the path of travel of the carrier sleeve.

4. Apparatus according to claim 3, including additionally static folding means for folding the leading dust flaps back toward the trailing dust flaps.

5. Apparatus according to claim 1, wherein the first carrier sleeve moving means also pushes the carrier sleeve over the support surface and is disengaged from the carrier sleeve after the pusher means of the second carrier sleeve moving means engages and begins to push the carrier sleeve along its path of travel.

6. Apparatus according to claim 5, wherein the speed of the pusher means of the second carrier sleeve moving means is greater than the speed of the first carrier sleeve moving means.

7. Apparatus according to claim 6, wherein the first carrier sleeve moving means comprises flight bars attached to endless chain means positioned below the path of travel of the carrier sleeve.

8. Apparatus according to claim 7, wherein the pusher means is attached to endless chain means positioned above the path of travel of the carrier sleeve and wherein the adjacent ends of the endless chain associated with the pusher means and the endless chain associated with the flight bars overlap with respect to the path of travel of the carrier sleeve.

* * * * *